US009886726B1

(12) United States Patent
Gauvin

(10) Patent No.: US 9,886,726 B1
(45) Date of Patent: Feb. 6, 2018

(54) ANALYZING SOCIAL NETWORKING GROUPS FOR DETECTING SOCIAL NETWORKING SPAM

(75) Inventor: William Gauvin, Leominster, MA (US)

(73) Assignee: SYMANTEC CORPORATION, Cupertino, CA (US)

( * ) Notice: Subject to any disclaimer, the term of this patent is extended or adjusted under 35 U.S.C. 154(b) by 2691 days.

(21) Appl. No.: 12/415,862

(22) Filed: Mar. 31, 2009

(51) Int. Cl.
*G06Q 99/00* (2006.01)
*G06Q 50/00* (2012.01)

(52) U.S. Cl.
CPC ..... *G06Q 50/01* (2013.01)

(58) Field of Classification Search
USPC ..... 705/1.1, 319, 500
See application file for complete search history.

(56) References Cited

U.S. PATENT DOCUMENTS

| | | | | |
|---|---|---|---|---|
| 7,120,927 | B1 * | 10/2006 | Beyda et al. | 726/2 |
| 7,953,814 | B1 * | 5/2011 | Chasin et al. | 709/207 |
| 2007/0061211 | A1 * | 3/2007 | Ramer et al. | 705/25 |
| 2009/0106065 | A1 * | 4/2009 | Bowie et al. | 705/7 |
| 2010/0070485 | A1 * | 3/2010 | Parsons et al. | 707/709 |

OTHER PUBLICATIONS

Lin, Y-R. et al., "The Splog Detection Task and a Solution Based on Temporal and Link Properties," TREC Blog Track, 2006, pp. 1-14.
Lin, Y-R. et al., "Splog Detection Using Content, Time and Link Structures," IEEE International Conference on Multimedia and Expo, 2007, 4 pages.

* cited by examiner

*Primary Examiner* — Lynda C Jasmin
*Assistant Examiner* — Shaun D Sensenig
(74) *Attorney, Agent, or Firm* — Patent Law Works LLP

(57) ABSTRACT

Social networking spam is detected using usage profiles for social networking groups. A mapping module maps a social networking group with a number of members. A pattern module determines a pattern of publishing activity of the members in posting information on blogs of other of the members. A profiling module defines a group usage profile for the social networking group based on the pattern. Global usage profiles can also be created for the social networking environment. An identification module identifies when a new entry has been posted on a blog of a members of a social networking group. An analysis module analyzes the new entry in comparison to a group usage profile (or other profiles). A determination module determines whether the new entry deviates from the pattern of activity of the members based on the analysis. If the new entry deviates, a spam detection module detects that the new entry is spam.

13 Claims, 8 Drawing Sheets

ANALYZING SOCIAL NETWORKING GROUPS FOR DETECTING SOCIAL NETWORKING SPAM

BACKGROUND OF THE INVENTION

Field of the Invention

This invention pertains in general to security management for social networking websites, and more specifically to analyzing social networking groups and anomalies in blog publishing occurrences to detect social networking spam.

Description of the Related Art

Social networking websites have opened up many new avenues to building a social network by allowing people to share information online and connect to a wide range of different users. Social networking websites, such as FACEBOOK®, MYSPACE®, and LINKEDIN®, allow users to build online profiles (user "sites") including information about the users that can be made available to other users in the network. The user can typically post photos, send messages, comment on friends' sites, join user groups, and generally interact and build online communities of users who share common interests. Social networking sites also commonly include blogs or notes pages on which users can post comments and communicate with other users. The amount and types of information that can be shared in these social networking environments is vast, and a given user's network can grow over time as the user connects to more and more other users.

With this current social networking phenomenon, however, comes an increased focus on security concerns. Spam has been cluttering email inboxes for quite a while now, frustrating users with unsolicited bulk messages advertising wide arrays of products or otherwise attempting to distract users. Spam, however, is not limited to email, and in fact comes in a variety of forms including mobile phone spam, instant messaging spam, online game messaging spam, and many others. Social networking websites have also been facing problems with spam (called blog spam or splogs), in which spammers post advertisements or random comments on a social networking user's blog or wall associated with his networking site. For example, a spammer might post a hyperlink on a social networking user's blog that points to the spammer's website with the goal of artificially increasing the search engine ranking of that site so that it is listed above other sites in certain searches. In some cases, where a user on a social networking website clicks on the spammer's hyperlink, the spammer actually takes the user's ID and post to the blogs of that user's friends using his ID. Those friends see the hyperlink from an ID they recognize, so they click on it and thus continue the propagation of the spam. Spam on social networking sites takes up valuable resources in both network bandwidth and user time, and it is a growing problem for social networking.

Detection of spam in blogs, such as the blog or notes pages included on many social networking sites, has generally been based on Uniform Resource Locator (URL) processing and context heuristics. Specific words can be blocked from posts on blogs that relate to commonly posted advertisements (e.g., VIAGRA® or other commonly sold pharmaceuticals). However, this can be a problem for legitimate bloggers who may want to discuss a blocked topic. Another method is to require validation of users prior to allowing the user to post comments on a website. Employing a reverse Turing test can prevent spam by requiring all entities posting content on a blog to answer a question or otherwise take a test that is easy for humans to pass, but difficult for an automated spam tool to pass. The drawback is that this test quickly becomes a nuisance, especially to persons who post comments frequently on blogs. While much research and implementation has been done to alleviate problems with spam in e-mail, relatively little research has been conducted regarding how to deal with spam that invades blogs or social networking sites. Thus, this type of spam continues to be a difficult to control problem, and a drain on network and user resources.

Therefore, there is a need in the art for a solution that analyzes social networks and anomalies in publishing occurrences, and uses this information to detect spam.

DISCLOSURE OF INVENTION

The above and other needs are met by a method, computer-implemented system, and computer program product for analyzing social networking groups and anomalies in blog publishing occurrences to detect social networking spam. An embodiment of the method includes identifying that a new entry has been posted on a blog of a member of a social networking group having a number of members and being a subset of users within a social networking environment. The method also includes analyzing the new entry in comparison to a group usage profile for the social networking group. The group usage profile indicates a pattern of publishing activity of the members in posting information on blogs of other members of the social networking group over a period of time. In addition, the method includes determining whether the new entry deviates from the pattern of publishing activity of the members based on the analysis, and detecting that the new entry is spam in response to a determination that the new entry deviates from the pattern. In some embodiments, the method further includes mapping the social networking group. In these embodiments, the method also includes determining the pattern of publishing activity of the members in posting information on blogs of other of the members of the social networking group over a period of time, and determining a pattern of global publishing activity of users in posting information on blogs of other users in the social networking environment. In these embodiments, the method further includes defining the group usage profile for the social networking group and defining a global usage profile for the social networking environment.

In an embodiment of the system, an identification module identifies that a new entry has been posted on a blog of a member of a social networking group having a number of members and being a subset of users within a social networking environment. An analysis module analyzes the new entry in comparison to a group usage profile for the social networking group. The group usage profile indicates a pattern of publishing activity of the members in posting information on blogs of other of the members of the social networking group over a period of time. A determination module determines whether the new entry deviates from the pattern of publishing activity of the members based on the analysis. A spam detection module detects that the new entry is spam in response to a determination that the new entry deviates from the pattern. In some embodiments, the system includes a mapping module for mapping the social networking group, and a pattern module for determining the pattern of publishing activity of the members in posting information on blogs of other members of the social networking group over a period of time. The pattern module can also determine a pattern of global publishing activity of users in posting information on blogs of other users in the social networking environment. In these embodiments, the system further includes a profiling module that defines the group usage profile for the social networking group and defines a global usage profile for the social networking environment.

The features and advantages described in this disclosure and in the following detailed description are not all-inclusive, and particularly, many additional features and advantages will be apparent to one of ordinary skill in the relevant art in view of the drawings, specification, and claims hereof. Moreover, it should be noted that the language used in the specification has been principally selected for readability and instructional purposes, and may not have been selected to delineate or circumscribe the inventive subject matter, resort to the claims being necessary to determine such inventive subject matter.

The figures depict an embodiment of the present invention for purposes of illustration only. One skilled in the art will readily recognize from the following description that alternative embodiments of the structures and methods illustrated herein may be employed without departing from the principles of the invention described herein.

DETAILED DESCRIPTION OF THE PREFERRED EMBODIMENTS

Figure 1A:
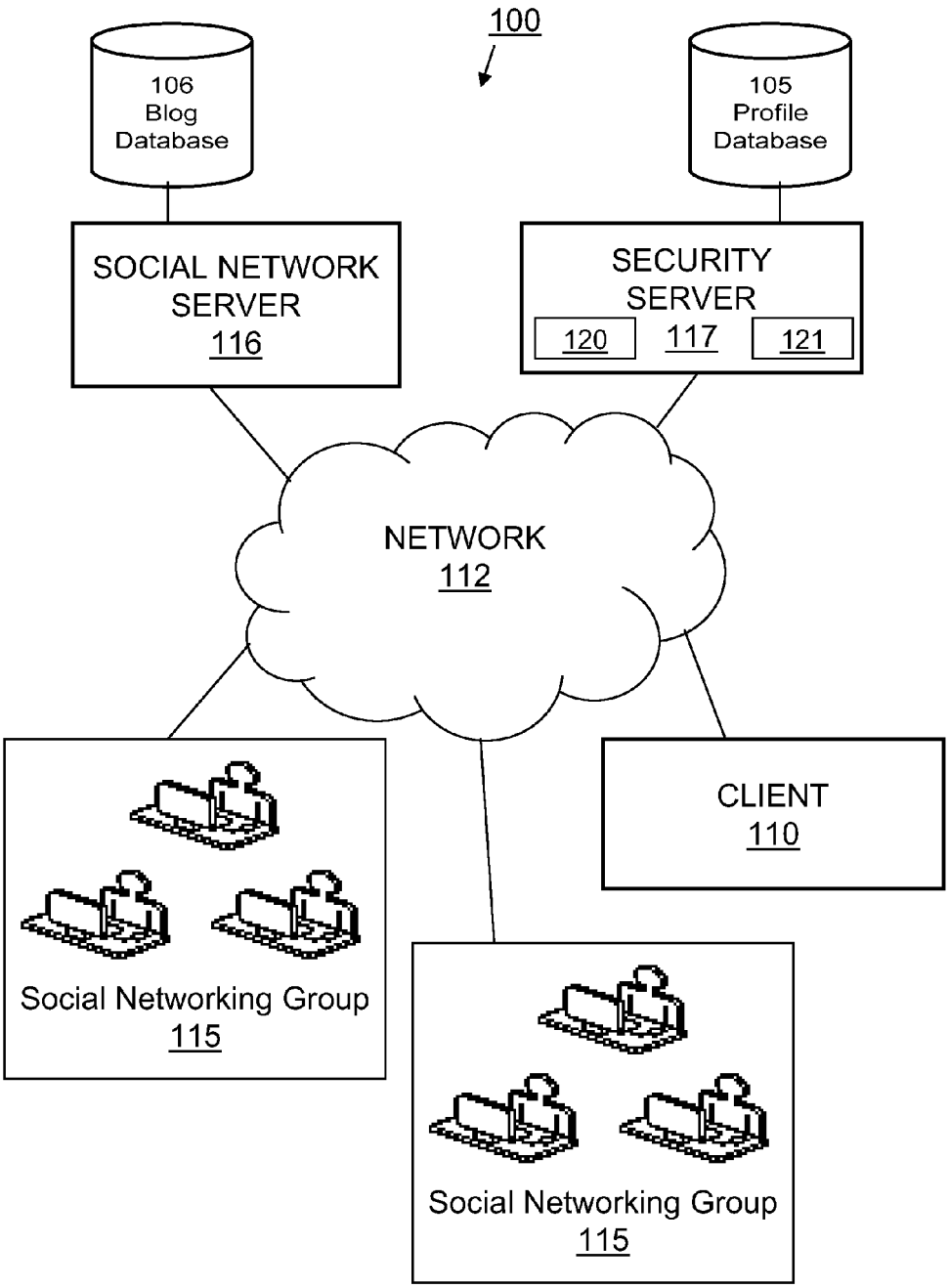
FIG. 1*a* is a high-level block diagram illustrating an example of a computing environment 100, according to one embodiment of the present invention.
Figure 1B:
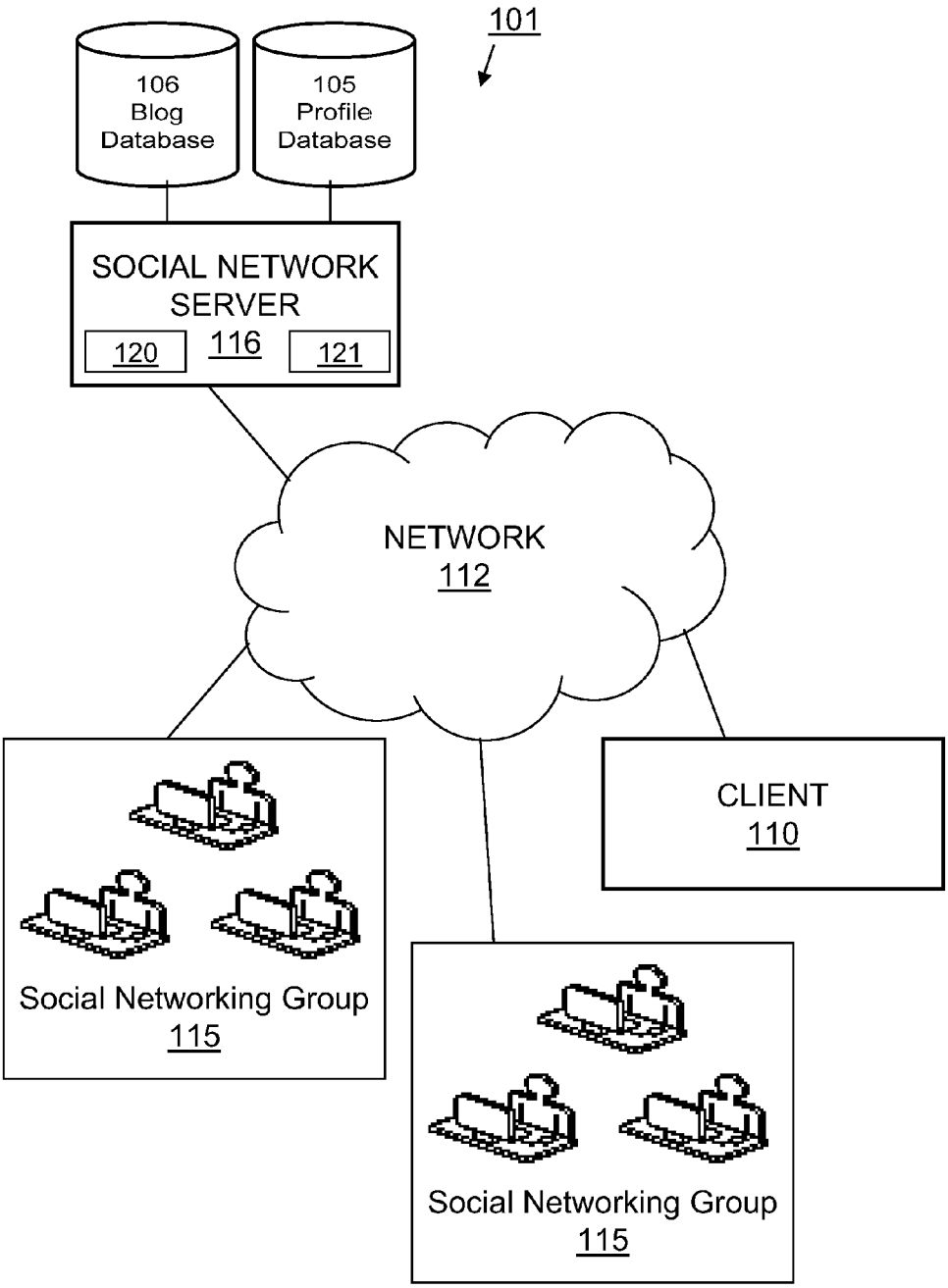
FIG. 1*b* is a high-level block diagram illustrating an example of another computing environment 101, according to one embodiment of the present invention.
Figure 1C:
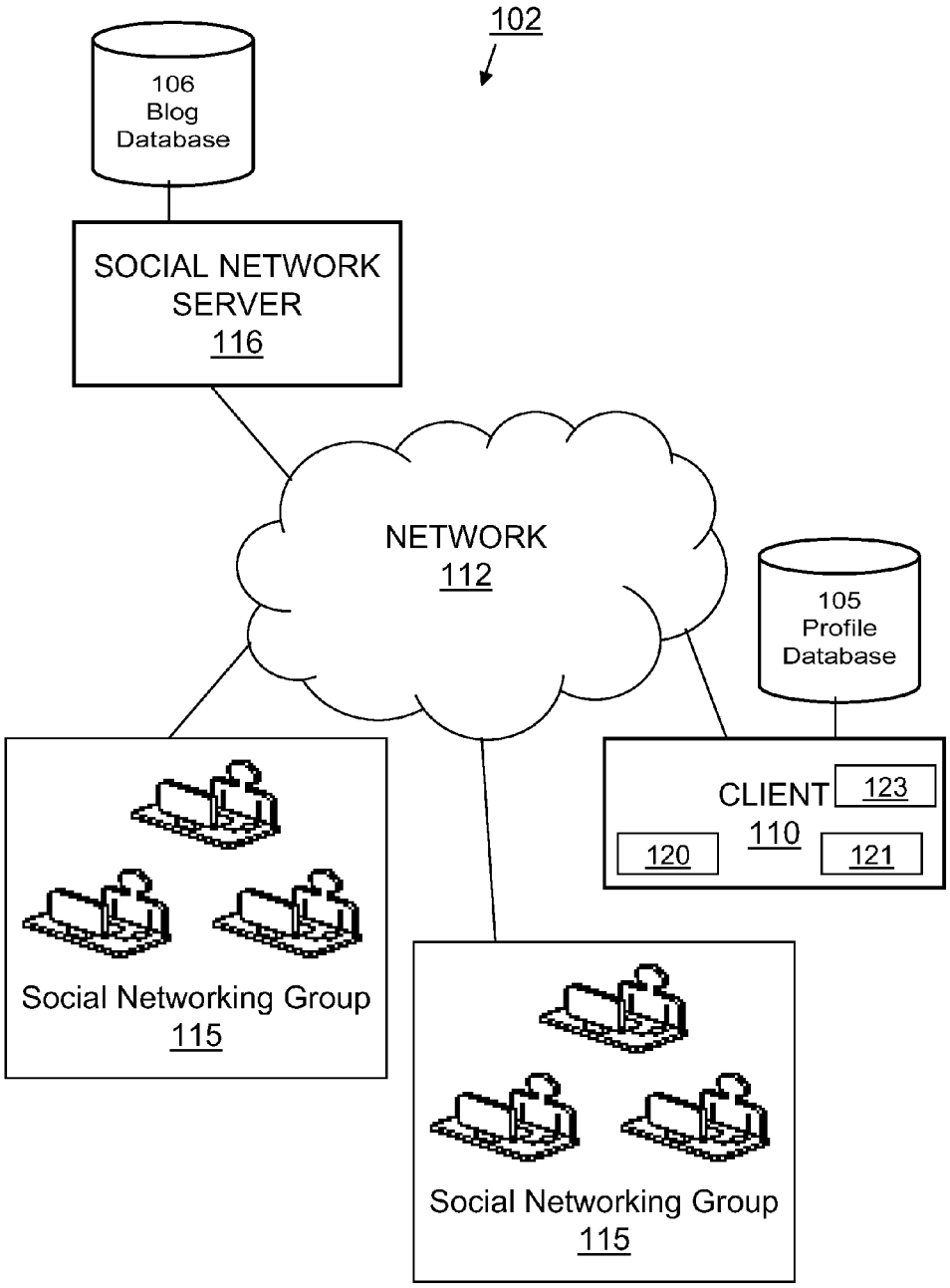
FIG. 1*c* is a high-level block diagram illustrating an example of another computing environment 102, according to one embodiment of the present invention.

FIGS. 1*a*, 1*b*, and 1*c* are high-level block diagrams illustrating computing environments 100, 101, 102 according to an embodiment. FIGS. 1*a*, 1*b*, and 1*c* illustrate a social network server 116, a client 110, and social networking groups 115 connected by a network 112. FIG. 1*a* further illustrates a security server 117. Only two social networking groups 115 and only one client 110 are shown in FIGS. 1*a*, 1*b*, and 1*c* in order to simplify and clarify the description. Embodiments of the computing environments 100, 101, 102 can have thousands or millions of social networking groups 115 and clients 110, as well as multiple servers. In some embodiments, the clients 110 are only connected to the network 112 for a certain period of time or not at all.

The social network server 116 and the security server 117 (in FIG. 1*a* only) both serve information or content to clients 110 via the network 112. In one embodiment, the social network server 116 is located at a website provided by a social networking service (e.g., FACEBOOK®, MYSPACE®, LINKEDIN®, etc.), although the server can also be provided by another entity. In one embodiment, the security server 117 is located at a website provided by SYMANTEC CORPORATION, although the server can also be provided by another entity. The servers 116, 117 can each include a database storing information and a web server for interacting with clients 110. As shown in FIG. 1*a* the social network server 116 includes a blog database 106 for storing blogs and blog content from a social networking environment, and the security server 117 includes a profile database 105 for storing user/member profiles, social networking group profiles, spam profiles, etc. In FIG. 1*b*, the profile database 105 is associated with the server 116, and in FIG. 1*c*, the database 105 is associated with the client 110. The servers 116, 117 can send information stored in the databases 105, 106 across the network 112 to each other and to the clients 110. For example, in FIG. 1*a*, the social network server 116 can provide social networking information, such as blogs from the blog database 106, for a security review to the security server 117. In some embodiments this information is sent in response to a request by the security server 117 or by client 110. In some embodiments, the security server 117 (FIG. 1*a*) or the client 110 (FIG. 1*c*) "scrapes" the information off of server 116 (e.g., using an HTML scraper), or acquires the information from the server 116 using a social networking website interface. In other embodiments this information is pushed by the social network server 116 to the security server 117 (FIG. 1*a*) or to the client 110 (FIG. 1*c*). In FIG. 1*b*, the social networking server 116 performs the functions of the security server 117, and so the social networking information 116 held by the server 116 is used by the server 116 rather than being sent elsewhere. The social networking groups 115 can access their social networking pages provided by the social network server 116.

The social networking groups 115 illustrated in FIGS. 1*a*, 1*b*, and 1*c* are groups of individuals that network together socially. These social networking groups 115 are subsets of users within a social networking environment (e.g., all of the users of social networking services provided by social networking websites, such as FACEBOOK®). These individuals can interact on social networking websites, which allows them to create online profiles or sites, communicate with one another, upload photos, post comments on blogs, etc. The social networking groups 115 are defined using an algorithm, as explained in more detail below. In some embodiments, the social networking group 115 includes users of a social networking service that are linked together as "friends" (e.g., where the service requires that both users confirm they are friends to view each others' personal sites). In other embodiments, the social networking groups 115 include subsets of the "friends" group, or other groups in which one or more of the members are not connected as "friends."

The clients 110 are computers or other electronic devices that can interact with the server 116, 117 or other clients 110. The clients 110, for example, can be personal computers executing a web browser that allows the user to browse and search for information available at a website associated with the server. In other embodiments, the clients 110 are network-capable devices other than a computer, such as a personal digital assistant (PDA), a mobile telephone, a pager, a television "set-top box," etc. The client 110 preferably execute an operating system (e.g., LINUX®, one of the versions of MICROSOFT WINDOWS®, and PALM OS®), which controls the operation of the computer system, and executes one or more application programs. The clients 110 can perform activities and make requests for or otherwise acquire information from the server 116, 117, or other computers 110. In one embodiment, users of the social networking groups 115 use clients similar to client 110 to access the social networking website via the social network server 116, and can post content on their personal sites or on the sites of others using the clients 110. As used herein, the term "site" refers to a user's personal site or profile for a social networking website, including the locations at which information can be posted on commented on (e.g., the user's walls, pages, blogs, notes pages, bulletins, etc.), the information the user provides about himself, his photos, and any other information a user might typically post on a social networking website.

The network 112 enables communications among the entities connected to it. In one embodiment, the network 112 is the Internet and uses standard communications technologies and/or protocols. Thus, the network 112 can include links using technologies such as Ethernet, 802.11, worldwide interoperability for microwave access (WiMAX), 3G, digital subscriber line (DSL), asynchronous transfer mode (ATM), InfiniBand, PCI Express Advanced Switching, etc. Similarly, the networking protocols used on the network 112 can include multiprotocol label switching (MPLS), the transmission control protocol/Internet protocol (TCP/IP), the User Datagram Protocol (UDP), the hypertext transport protocol (HTTP), the simple mail transfer protocol (SMTP), the file transfer protocol (FTP), etc. The data exchanged over the network 112 can be represented using technologies and/or formats including the hypertext markup language (HTML), the extensible markup language (XML), Java™, ColdFusion Script (CFScript), .NET, etc. In addition, all or some of links can be encrypted using conventional encryption technologies such as the secure sockets layer (SSL), transport layer security (TLS), virtual private networks (VPNs), Internet Protocol security (IPsec), etc. In another embodiment, the entities use custom and/or dedicated data communications technologies instead of, or in addition to, the ones described above.

In the embodiment illustrated in FIG. 1*a*, the security server 117 executes a profiling engine 120 for mapping social networks and creating usage profiles. The server 117 also executes a detection engine 121 for analyzing postings on walls or blogs of users stored by the social network server 116, and detecting spam in those blogs (splogs). As used herein, the term "blog" refers to any type of weblog or page on which users can write or post information/comments, including a user's site, walls or pages of a user's site, notes pages, social networking bulletins, and so forth. In FIG. 1*b*, the social network server 116 executes the engines 120, 121. In FIG. 1*c*, the client 110 executes the engine 120, 121. The engines 120, 121 can be discrete application programs, or can be integrated into another application program or the operating system for either of the servers 116, 117 or the client 110. In some embodiments, the engines 120, 121 are provided on a cloud service acting as a server. In some embodiments, one of the engines 120, 121 or a portion of one or both of the engines 120, 121 is divided between the servers 116, 117 or the client 110.

The profiling engine 120 of FIG. 1*a* maps various different social networking groups 115 of a social networking environment. For example, the engine 120 can apply an algorithm to identify the users who make up a social networking group 115. The groups 115 shown in FIG. 1 illustrate only three users, but there can be many users in each social networking group 115. The engine 120 further determines patterns of activity associated with the social networking groups and associated with the overall social networking environment. For example, the engine 120 can determine patterns of the members of the group in posting information on blogs of other of the members. The engine 120 can also determine global patterns of users in the social networking environment in posting information on blogs of other users in the environment. The engine 120 creates usage profiles based on the patterns observed (e.g., group usage profiles and global usage profiles). The global usage profiles can include holiday usage profiles indicating usage patterns of users during holiday times or other pre-determined periods when usage patterns are expected to change. The global usage profiles can also include spam usage profiles indicating patterns of spammers in posting information on blogs. The engine 120 can store these profiles in the profile database 105, which can then be used in spam detection.

The detection engine 121 of FIG. 1*a* monitors communications of social networking groups 115, including monitoring the posting of information on blogs stored in the blog database 106 associated with social networking websites. The engine 121 notes when a new entry is posted on a blog or wall of a social networking page. The engine 121 analyzes the new entry in comparison the usage profiles created by engine 120 and stored in the profile database 105 for the social networking group. The engine 121 then determines whether or not the new entry is spam. For example, the engine 121 can do this by determining whether the new entry deviates from the group publishing patterns of the group usage profiles. The engine 121 can also compare the new entry to global usage patterns, including determining if it matches a spam usage profile or determining if it deviates from holiday usage patterns. The engine 121 can do a validation of the spam detection to confirm that it really is spam. If the entry is determined to be spam, the engine 121 can send a notification of spam detection (e.g., to users of clients 110, to the social networking server 116, or other entities), and the spam can be dealt with accordingly (e.g., deleted, grouped with similar entries and compressed into one entry; stored for future spam detections, etc.).

Where the engines 120, 121 are executed on the social networking server, as shown in FIG. 1*b*, they function in the same manner as described above for FIG. 1*a*. However, in this case, it is the social networking server 116 itself that is mapping and profiling the social networking groups 115, and then performing the spam detection. In this case, the server 116 is performing the function of the security server 117, and can maintain the profile database 105. The server 116 can thus manage any spam detected in users' blogs (e.g., by deleting or condensing splogs). Though not shown in FIG. 1*b*, in one embodiment, the server 116 executes the engine 120 to map and profile the social networking groups, while a security server 117 executes engine 121 to conduct spam detection using those profiles.

Where the engines 120, 121 run on the client 110, as shown in FIG. 1*c*, the engines 120, 121 generally function in the same manner as described above for FIG. 1*a*. However, where processing power and bandwidth are limited, as could be true of a client 110, only a portion of the social networking environment will be mapped and analyzed. For example, where the engines 120, 121 are executed on a client 110, the profiling engine 120 might only map the social networking group 115 for the user of the client 110. In this case, the engine 120 can determine patterns of usage and group profiles for that user's own social networking group 115 (rather than for the entire social networking environment). These usage profiles are stored by the client 110 in profile database 105 of FIG. 1*c*. Similarly, the detection engine 121 running on the client 110 might only detect spam in blogs of the user or of other members of the user's group 115, rather than performing spam detection across the entire social networking environment, as can be done with the servers 116, 117. In this case, the client 110 itself can modify the user's blog to manage any spam detected (e.g., by deleting the splogs or condensing duplicate splogs). In some embodiments in which the client 110 executes the engines 120, 121, the client 110 has access to global profiles, as well. For example, server 116 could create global profiles that could then be accessed by or provided to the client 110 for usage in spam detection in the blog of a user of client 110.

Though not shown in FIG. 1*c*, in some embodiments, the client 110 might execute only the profiling engine 120 to profile the group 115 for a user of the client 110, but then the client 110 could provide this information to a security server 117 executing engine 121 for spam detection. In another embodiment, the client 110 might execute only the detection engine 121. In this case, the client 110 could obtain profile information from a server 116, 117 executing profiling engine 120 to perform spam detection for the user of client 110. Other variations of functionality are possible, as well.

As also illustrated in the FIG. 1*c* embodiment, the client 110 executes a rendering module 123. This module 123 modifies the content received by the social network server 116 and renders the modified version (e.g., the blog with deleted spam entries or consolidated spam entries) to the user. In this embodiment, the client is not dependent on the social networking server 116 to render the modified blog. The rendering module 123 allows the client 110 to provide full spam detection functionality in social networking environment in which the blog content is rendered by the client 110 without spam or with consolidated spam.

Figure 2:
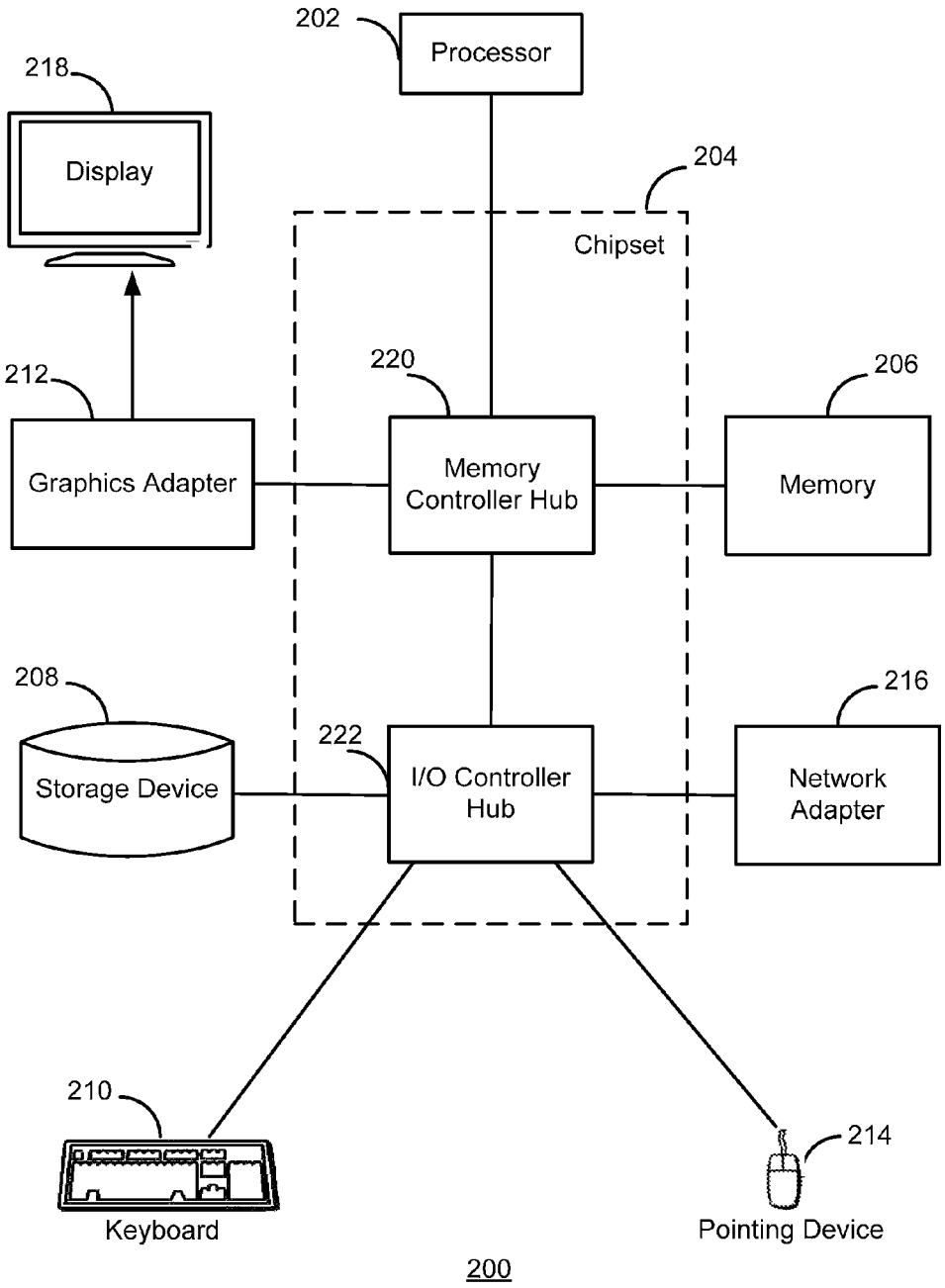
FIG. 2 is a high-level block diagram illustrating a computer system 200 for use with the present invention.

FIG. 2 is a high-level block diagram illustrating an example of a computer 200 for use as a server 16 and/or client 110. Illustrated are at least one processor 202 coupled to a chipset 204. The chipset 204 includes a memory controller hub 220 and an input/output (I/O) controller hub 222. A memory 206 and a graphics adapter 212 are coupled to the memory controller hub 220, and a display device 218 is coupled to the graphics adapter 212. A storage device 208, keyboard 210, pointing device 214, and network adapter 216 are coupled to the I/O controller hub 222. Other embodiments of the computer 200 have different architectures. For example, the memory 206 is directly coupled to the processor 202 in some embodiments.

The storage device 208 is a computer-readable storage medium such as a hard drive, compact disk read-only memory (CD-ROM), DVD, or a solid-state memory device. The memory 206 holds instructions and data used by the processor 202. The pointing device 214 is a mouse, track ball, or other type of pointing device, and is used in combination with the keyboard 210 to input data into the computer system 200. The graphics adapter 212 displays images and other information on the display device 218. The network adapter 216 couples the computer system 200 to the network 112. Some embodiments of the computer 200 have different and/or other components than those shown in FIG. 2.

The computer 200 is adapted to execute computer program modules for providing functionality described herein. As used herein, the term "module" or "engine" refer to computer program instructions and other logic used to provide the specified functionality. Thus, a module/engine can be implemented in hardware, firmware, and/or software. In one embodiment, program modules/engines formed of executable computer program instructions are stored on the storage device 208, loaded into the memory 206, and executed by the processor 202.

The types of computers 200 used by the entities of FIGS. 1*a*, 1*b*, and 1*c* can vary depending upon the embodiment and the processing power used by the entity. For example, a client 110 that is a mobile telephone typically has limited processing power, a small display 218, and might lack a pointing device 214. The server 116, in contrast, may comprise multiple blade servers working together to provide the functionality described herein.

Figure 3A:
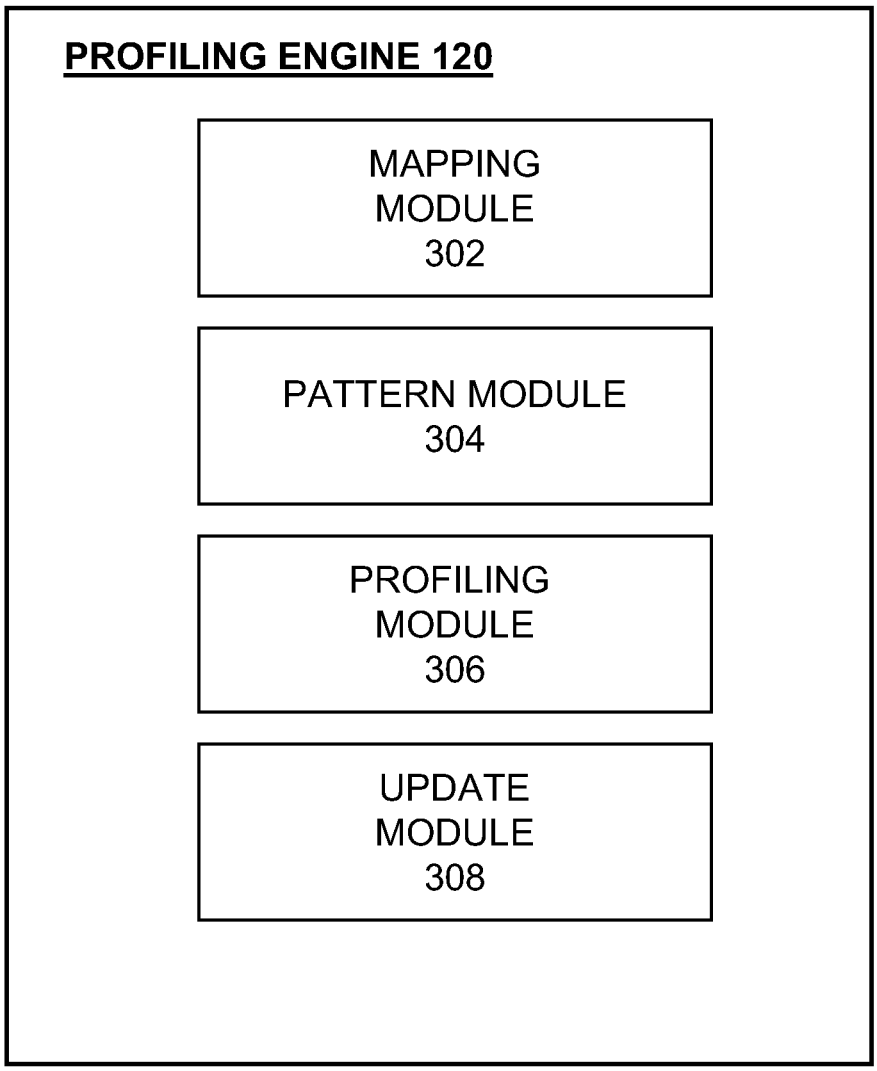
FIG. 3*a* is a high-level block diagram illustrating the functional modules within the profiling engine 120, according to one embodiment of the present invention.
Figure 3B:
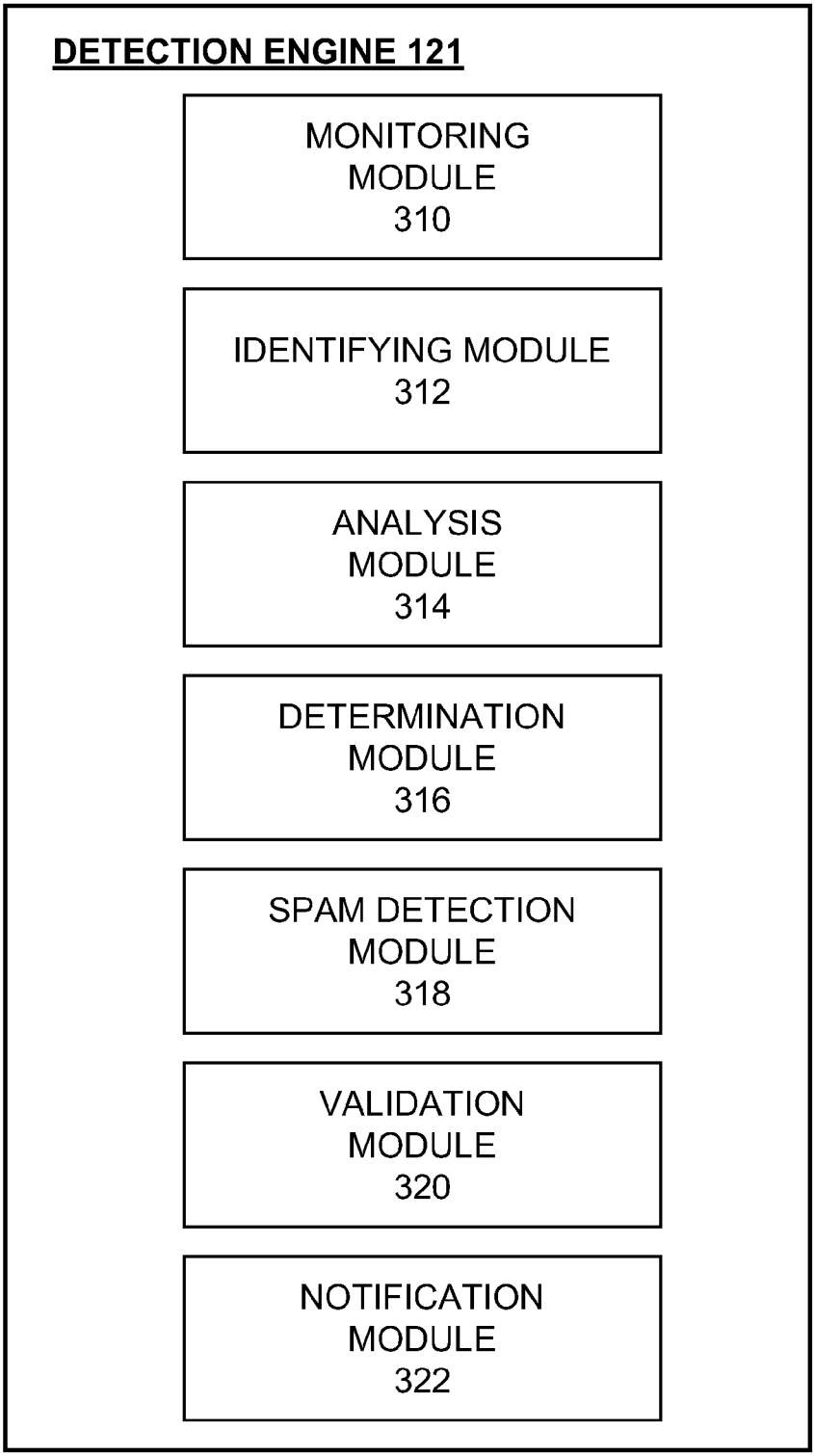
FIG. 3*b* is a high-level block diagram illustrating the functional modules within the detection engine 121, according to one embodiment of the present invention.

FIGS. 3*a* and 3*b* are high-level block diagrams illustrating the functional modules within the profiling engine 120 and detection engine 121, respectively, according to one embodiment of the present invention. The profiling engine 120, in the embodiment illustrated in FIG. 3*a*, includes a mapping module 302, a pattern module 304, a profiling module 306, and an update module 308. The detection engine 12, in the embodiment illustrated in FIG. 3*b*, includes a monitoring module 310, an identifying module 312, an analysis module 314, a determination module 316, a spam detection module 318, a validation module 320, and a notification module 322. Some embodiments of the profiling engine 120 and the detection engine 121 have different and/or additional modules than those shown in FIGS. 3*a* and 3*b*, and the other figures. Likewise, the functionalities can be distributed among the modules in a manner different than described herein or can be incorporated into a single module. Certain modules and functions can be incorporated into other modules of the engines 120, 121, and/or other entities on the network 112, including the server 116 or clients 110.

The mapping module 302 maps a social networking group 115 comprising a plurality of members. The social networking group 115 is a subset of users within a social networking environment. For example, the social networking group 115 could be a group of ten friends who are closely linked and write regularly on one another's sites (e.g. their blogs, walls, or other areas containing personal content) on a social networking website. Social networking websites, such as such as FACEBOOK® or MYSPACE®, allow users to build their own online sites including information about the user that can be made available to other users in the network. Users can typically upload a picture of themselves and can be "friends" with other users. For many social networking websites, both users must confirm that they are friends before they are connected and able to view each others' sites. Users can typically post photos, send messages, comment on friend's sites, join user groups, write on other users' sites (e.g. write on their walls, blogs, notes pages) etc. Many social networking websites permit a user site to be marked "public" or marked "private," or otherwise allow the user to limit who can see his information. In this manner, a user can allow his site to be made available on the social networking website to anyone who visits the website (a public site) or can choose to only let the people he approves as "friends" view his site (a private site).

The mapping module 302 defines subsets of a social networking environment, referred to here as "social networking groups" 115. These subsets are users that belong to the same social networking "circle" and are commonly named "friends." There are often several levels of friendships in a social network. Active participants are those who generally write to the wall (site) of other members, and voyeurs are those who generally only view sites, but post little or no content to sites, blogs, walls, etc.

The module 302 can apply an algorithm to define social networking groups 115. In one embodiment, the module 302 randomly selects a central user for whom the social networking group 115 will be defined (or where client 110 executes module 302, the user selected can be the user of client 110). Using grouping techniques, such as the Kleinberg authoritative/hub algorithm, the social networking group 115 for the central user can be ascertained. Once the group has been determined using the grouping algorithm, a different algorithm can be used to perform traffic analysis on the level of activity on the walls. Many social networking websites, such as MYSPACE®, provide the ability for viewing of all "public" sites. Other social networking websites require membership into the website before allowing the viewing of any sites. In both environments, a grouping algorithm, such as the Kleinberg algorithm, adjacency list, or other algorithms, can be used to derive a social networking group 115.

In an embodiment in which the Kleinberg algorithm is used to map the social network, the technique uses a modification to the Kleinberg algorithm, which provides an incremental weight specifically for each blog entry and doubles the weight when the communication is bi-directional between members. This technique ensures that members that correspond with each other more often will move to the top, creating high degrees of association between these members. The association can also be time sensitive (e.g., based on the time/date frequency of the post).

For the purpose of illustration, an example of how the module 302 can use the Kleinberg algorithm to map a social network is provided here. The Kleinberg algorithm is used here to identify the members of a social networking group 115. The algorithm determines how users are connected, where stronger connections are found between users that link to each other or tend to communicate with each other frequently. The Kleinberg algorithm defines two different classes of importance, called "hubs" and "authorities," and the algorithm is used to automatically recognize leading hubs and authorities in a network of users. Hubs and authorities exhibit a mutually reinforcing relationship, and this relationship can be ascertained using in-degree and out-degree measurements on both endpoints. In this manner, the algorithm can be used to rank relationships in a social network.

The module 302 can scan a user's site, and then the sites of all "friends" and those friends' "friends" to create a complete relationship map. In some embodiments, the users are given the option to opt in to the analysis performed by the content engine 121. In this case, users can provide password or ID information to the profiling engine 120 so the engine can scan the users' sites. The Kleinberg algorithm uses blogs or walls of social networking websites as the endpoint of analysis. The implementation of the algorithm is predicated on the use of a directed graph with directed edges $(p, q) \epsilon E$ that represents the presence of a link from p to q, which are the vectors (nodes) from source to destination that correspond to the publisher of a blog entry p and to the site/blog owner q via the presence of a blog (link) E. The out-degree of p is the number of user sites it has links to (e.g., number of blogs posted on individual profile sites); the in-degree of p is the number of links to it from another site (e.g., number of blogs contained/posted within profile/site of p from other members of the social network). This is commonly referred to as the endorsement of p and q, and when it is bi-directional, it is mutually endorsing.

The basic premise of the algorithm is to isolate small regions, such that $P \subseteq V$ is a subset of user sites, in which G[P] denotes the graph induced on P (it's user site blogs and the content within) that corresponds to the link and strength of the relationship between two user sites. P represents the results of all the top level profiles after the Kleinberg/endorsement algorithm is executed. This P has a relationship with V, in that it has the highest "scores" or endorsement (e.g., based on some range entered in the algorithm). For example, starting with a social network that has 100 users, if 50 of those users never post blogs, they are quickly removed from the group P. Furthermore, 25 members might only post once and then are not active, so they too are quickly removed from P because they do not meet the "score" or threshold hold criteria. What is left is a group P of 25 members that are strongly tied. G[P] is the graph produced by this relationship.

The symbol $\sigma$ is used to represent the blog content which is parsed to obtain the directed graph relationships. Specifically, users' sites on a social networking website are each assigned site IDs. This site ID is parsed and this ID is used to obtain additional user site relationships which are then analyzed. Using this technique, authoritative pages are obtained by analysis based on the blog "link structure." The main result of this analysis is to identify a set $Q_\sigma$ of all user sites containing an association based on publishing an entry in a blog using the site ID as the link between two sites. This link is also used during link-count analysis; the more blogs entered under a specific ID (link), the stronger the relationship. The results of using this technique are that (1) $Q_\sigma$ is a relatively small set, (2) $Q_\sigma$ is rich in relevant user sites, and (3) $Q_\sigma$ contains most of the strongest authorities.

The algorithm, as identified by Kleinberg, defines a parameter t, which is the size of the set to be derived by analysis. The idea is to create a collection of the highest ranked user sites from a "query" (the results from a parse operation on a specific user blog). This t then becomes the root set of $R_\sigma$, and it is from the root set that $P_\sigma$ will be derived, satisfying the three numbered items listed above. Thus, $P_\sigma$ is the final set of profiles (e.g., as identified by user IDs) after a filtering process. The filtering algorithm limits the size of the set to a specific value. This filtering process may not be used all the time, e.g., when the sets are relatively small. It typically is used on large social networks (e.g., the profile/site of a popular band on MYSPACE®).

Kleinberg's sub-graph algorithm is modified to create the social networking relationship graph. The algorithm is the following:

Subgraph $(\sigma,E,t,d)$
$\sigma$: Blog content that is scanned and parsed
E: Text based scanning and parsing engine
t,d: Natural numbers
Let $R_\sigma$ denote the top t results of E on $\sigma$
Set $P_\sigma=R_\sigma$
For each site $p \epsilon R_\sigma$
  Let $\Gamma^+(p)$ denote the set of all sites p points to
  Let $\Gamma^-(p)$ denote the set of all sites pointing to p
  Add all sites $\Gamma^+(p)$ to $P_\sigma$
  if $\Gamma^-(p) \leq d$ then
    Add all sites in $\Gamma^-(p)$ to $P_\sigma$
  Else
    Add an arbitrary set of d pages from $\Gamma^-(p)$ to $P_\sigma$
End
Return $(P_\sigma)$ The result of the sub-graph routine is a graph, such that $G[P_\sigma]=G_\sigma$.

The goal of the algorithm is to iteratively update the site weights to establish the hub/authorities relationship. Two weight values are used, the non-negative authority weight $x^{<p>}$ and a non-negative hub weight $y^{<p>}$, which are both normalized so their squares sum to 1. This relationship is summarized below:

$$\Sigma_{p\in P_\sigma}(x^{<p>})^2=1$$

and $$\Sigma_{p\in P_\sigma}(y^{<p>})^2=1$$

The larger the x and y values, the better/stronger the relationship between the authorities and hubs. The general property for these values is the following: (1) if p points to many sites with a large x-value, then it should receive a large y-value, and (2) if p is pointed to by many sites with a large y-value, then it should receive a large x-value.

This property is specified using the following operation definitions:

An I operation such that:

$$x^{\langle p\rangle} \leftarrow \sum_{q:\langle q,p\rangle\in E} y^{\langle q\rangle}$$

And the O operation:

$$y^{\langle p\rangle} \leftarrow \sum_{q:\langle p,q\rangle\in E} x^{\langle q\rangle}$$

Both operations are used to reinforce each other. The iteration process can then be defined within the following function:

Iterate(G,k)
G: a collection of n linked site pages
k: a natural number
Let z denote the vector $(1, 1, 1, \ldots, 1)\in\Re^n$ (the base or initialization set for x and y)
Set $x_0$:=z
Set $y_0$:=z
For I=1, 2, . . . , k
  Apply the I operation to $(x_{i-1}, y_{i-1})$, obtaining a new x-weights $x_i'$
  Apply the O operation to $(x_i', y_{i-1})$, obtaining a new y-weights $y_i'$
  Normalize $x_i'$, obtaining $x_i$
  Normalize $y_i'$, obtaining $y_i$
End
Return $(x_k, y_k)$ This result can further be filtered to obtain the largest authorities and hubs. As the number of iterations increase, as specified by the input value k, the sequence of vectors returned by the Iterate function converge to a fixed point, x* and y*. A k value of 20 is generally sufficient for each vector to become stable.

Using Kleinberg's algorithm, an initial index point is identified. The start point is an entry in a blog, and each user's blog that is referenced by that initial blog is scanned using the Kleinberg constraints: (1) the user must have posted comment on a blog, and (2) the number of users is limited to the set $Q_\sigma$ which prevents the scan list from growing too large. The result is the mapping of social networking groups 115 defined by the mapping module 302.

Referring again to FIG. 3*a*, the pattern module 304 determines a pattern of publishing activity of the members of a social networking group 115 in posting information on blogs of other members of the group 115 over a period of time. The module 304 tracks the writing of each member of the group on another member's blog. Over time, the module 304 can determine specific usage patterns for the group. For example, if it is a group of high school friends, the publishing activity throughout the day might be the highest during lunchtime, right after school gets out, in the evenings, etc. For an older group of friends, publishing activity might only be high later in the evening after the members have gotten home from work. Similarly, there can be different patterns for different days of the week (e.g., higher activity on weekends than weekdays). Patterns can also differ for different months of the year. For example, in the fall months, activity might be higher for members of the group (e.g., 15 minute to one hour or more spurts of writing activity amongst members), while writing activity can be less in the summer (e.g., members may not respond for a day or more). In addition, the group might have different patterns over holiday times (e.g., less writing before or after the holidays, but more writing during certain holidays). The module 304 can thus determine these patterns for each group, and the patterns can be different for different groups.

In some cases, a group pattern can be embodied as a mathematical function, set of rules, fuzzy logic algorithm, or a probability distribution that models the behavior of a user or group of users. For example, a group pattern regarding common times of blog postings could be a frequency distribution over the times of day that users tend to be actively posting blog entries. That pattern would allow determination of unusual blogs based on a low probability of a non-spam user actively blogging in a particular time window (e.g., at 3 am) when other members of the group always post between 8 am and 10 pm. As another example, a group pattern on blog frequency-by-concept could be an observation-based rule that bloggers in the group always include the concept of religion when they post on Sunday.

In some embodiments, the pattern module 304 further determines a pattern of global publishing activity of users in posting information on blogs of other users in the social networking environment. Beyond the patterns that a particular social networking group 115 displays, there can be patterns for the overall social network. Similar to the patterns described above, there can be overall group patterns during holidays, during different times of the year, during different days of the month or week, during different times of day, etc.

In one embodiment, the pattern module 304 also determines patterns of publishing activity for spammers. Individuals posting spam on blogs typically display different writing patterns than non-spamming writers. For example, they might be more likely to write on blogs throughout the day, rather than having a 20-minute spurt of activity that might be seen with non-spammers. In addition, the spammers might display different activity patterns throughout the week, month, year, on holidays, etc. Thus, the module 304 can determine the patterns of spam writing over time.

The profiling module 306 defines one or more group usage profiles for the social networking group 115 based on the determination of the pattern of publishing activity of the members. When a user posts an entry on a blog, that entry persists. Using this aspect and applying traffic analysis, profiles can be created that identify patterns of use for the group. In many cases, this pattern can be derived by analyzing years of activity, and that activity can be categorized. Based on the information acquired by the pattern module 304, the profiling module 306 creates one or more profiles for each group 115. The profile(s) are created to represent the blogging patterns of the group throughout the year, and so can account for different patterns of the group throughout the day, week, month, year, during holidays, etc. In one embodiment, patterns of use are represented in binary form for easy comparison to other profile use patterns.

In some embodiments, the group usage profile includes a catalog of signatures for normal usage patterns of the social networking group during different times of a day, different days of a week, different weeks of the month, and different months of a year. These signatures can be used for matching with blog entries and identifying whether or not an entry fits within the group profile.

In some embodiments, the profiles include information about one or more of the following:

1. Time/date of publishing
2. Delta between publishing
3. Time/date of response from owner of site
4. Time/date of next publishing (from any site within the social networking group)
5. Content signature match between posts from the same and different individuals.
6. Content type match between posts from the same and different individuals
7. Clustering of "Holiday" categories (group and global)
8. Clustering of "event" categories (group specific)
9. Work/Leisure reference times (to include work, vacation, off hours, late hours with generally low activity)
10. Gender and age correlation of activity.
11. Login validation of the user The data above are collected and distribution analysis invoked to produce profile signatures which are used by the detection engine 121 in detecting spam. This engine used in the classification of blogs which are injected into the analysis engine.

In some embodiments, the profiling module 306 first defines a member usage profile for each member of the social networking group based on a pattern of publishing activity for that member in posting information on blogs of other members. The member usage profile for each member is used to generate the group usage profile for the social networking group.

In some embodiments, the profiling module 306 further defines one or more global usage profiles for the social networking environment based on patterns of global publishing activity of users (determined by the pattern module 304) in posting information on blogs of other users in the social networking environment. These profiles represent the patterns for an overall social network, including different patterns at different times. For example, the global profiles can include a holiday usage profile defining typical usage patterns for the users of the social networking environment during holidays.

In one embodiment, the global usage profiles include a spam usage profile including a plurality of known blog spam signatures. In general, splog activity resides outside the activity profile for normal users based on duration, object content, recurrence and duplication. As noted above, the duration of a spammer might last throughout the day, rather than in smaller amounts of time seen with normal users. Similarly, spammers tend to send a message to many different blogs, and typically it is the same message to everyone. The content of the message also commonly differs from what other users are talking about (e.g., a sales advertisement for VIAGRA®). Thus, spam usage profiles commonly define a pattern of providing repetitive content on the same wall within a specific timeframe, repetitive content on multiple walls within a specific timeframe, or polymorphic content that generally still uses the same traffic patterns. Polymorphic splogs are splogs that tend to change content slightly over different blogs. For example, one entry might provide a link with a statement "Hey, check this out," while another entry might provide the same link (or a slightly modified link) with a statement "Check this out." Polymorphic splogs become easier to detect across blogs using the profiling techniques described here.

The update module 308 updates the group usage profile(s) to include new usage patterns of the social networking group identified over time. Similarly, the module 308 can update any other profiles created by the profiling module 306. Since users may change their patterns in writing on walls of others over time, the module 308 recognizes these changes and updates the profiles. Over time, the profiles are thus adapted to represent new trends in social networking groups, and in the overall social networking environment.

Referring now to FIG. 3*b*, a monitoring module 310 monitors communications of members of social networking groups 115. The module 310 can generally determine when users are writing on other user's blogs, and can track social networking activity over time.

An identification module 312 identifies that a new entry has been posted on a blog of one of the members of a social networking group. Each blog entry typically has a timestamp and a unique ID associated with the writer of the entry, allowing the module 312 to identify the user who wrote the new entry. The module 312 can also identify the owner of the blog and the social networking group 115 to which the owner belongs. In one embodiment, an HTML scraper, which uses a Java processing engine to emulate Java script, requests a list of a logged-in user's friends and their blogs for analysis.

An analysis module 314 analyzes the new entry in comparison to the group usage profile (defined by the profiling module 306) for the social networking group 115. As new entries are identified by the identification module 312, the analysis module 314 analyzes them relative to the profiles created by the profiling module 306. The module 314 can examine the new entry created on a blog in reference to the group usage profile for the owner of that blog. The module 314 can also compare the entry to global usage profiles and to the member usage profile for the owner of the blog.

A determination module 316 determines whether the new entry deviates from the pattern of publishing activity of the members based on the analysis conducted by the analysis module 314. If an entry on the blog does not match the group usage profile associated with the blog owner, then the entry may be spam. If it does match, then it likely is not spam. The module 316 can also determine whether the entry deviates from the global usage profile(s) for the social networking environment. For example, if the entry does not match the patterns specified by the holiday usage profile for the social networking environment, the entry may be a splog. Similarly, if the entry matches the patterns specified by the spam usage profile, the entry may be spam.

A spam detection module 318 detects that the new entry is spam, responsive to a determination that the new entry deviates from the pattern. Since the group usage profiles represent the typical usage patterns of the social networking group 115, a blog entry that deviates from those patterns is likely to be spam.

As explained above, spammers sometimes steal the user ID of the user who clicks on the spammer's link, allowing the spammer to then send out additional spam under that user's ID. It is difficult to detect spam for individual pages since splogs steal content from normal blogs. The detection engine 121 has the advantage of using social network grouping in which the relationships between users has been predetermined using techniques, such as the Kleinberg algorithm, and the usage patterns of the group are predetermined and then used in spam detection.

A validation module 320 performs a validation of the spam detection. For example, an entry that was found to deviate from the group usage patterns can be verified against the spam usage profiles. The new entry can be compared to signatures representing known spam. Where the deviating entry matches the spam signatures, the module 320 decides that the detection was correct and the entry is spam. However, if the deviating entry does not match the spam signatures, the entry is less likely to be spam but may instead represent a new pattern of publishing activity for the group.

As one example, the group patterns for a social networking group 115 can indicate that the group members typically posts blog entries on weekends, between 5 pm and 10 pm. A new entry on a blog of various members of the group that was posted at midnight on Monday might be flagged as a deviating entry that could be spam. Comparison to spam signatures, however, can indicate that the content does not represent a spam pattern (e.g., the entry is not about VIAGRA® or other common spam topics). Instead, the odd time for the new entry might be attributed to a new schedule of one of the members that causes that person to post entries around midnight on weekdays. The module 320 can then decide that the new entry is not spam, and can store this new pattern in the group usage profile and/or global profiles.

In some embodiments, the validation module 320 determines whether the user that posted the new entry is logged in to the social networking website. Social networking websites typically provide a mechanism by which it is possible to determine whether a user is currently logged in (e.g., a flashing silhouette for that user, a login symbol, or other mechanisms). When a new entry is posted on a blog, the module 320 can thus determine if the user posting the entry is currently logged in. If the user is not, but is still posting to the walls of members of the social networking group, this is an indicator that malicious activity is occurring, and the user posting the new entry may be a spammer. Thus, the validation module 320 can also use this information to validate whether or not the new entry is spam.

In some embodiments, a notification module 322 sends out a notification or alarm that a spam detection has been made. The module 322 can notify the users of clients 110, can notify the social networking server 116, and other relevant entities. The splog activity can thus be managed accordingly. For example, multiple repetitive splogs can be condensed to one entry so the user does not have a cluttered wall. The splogs can also be permanently removed from a user's wall. In addition, the spam profiles can be updated over time as new splogs are identified, and new spam signatures can be generated.

Figure 4:
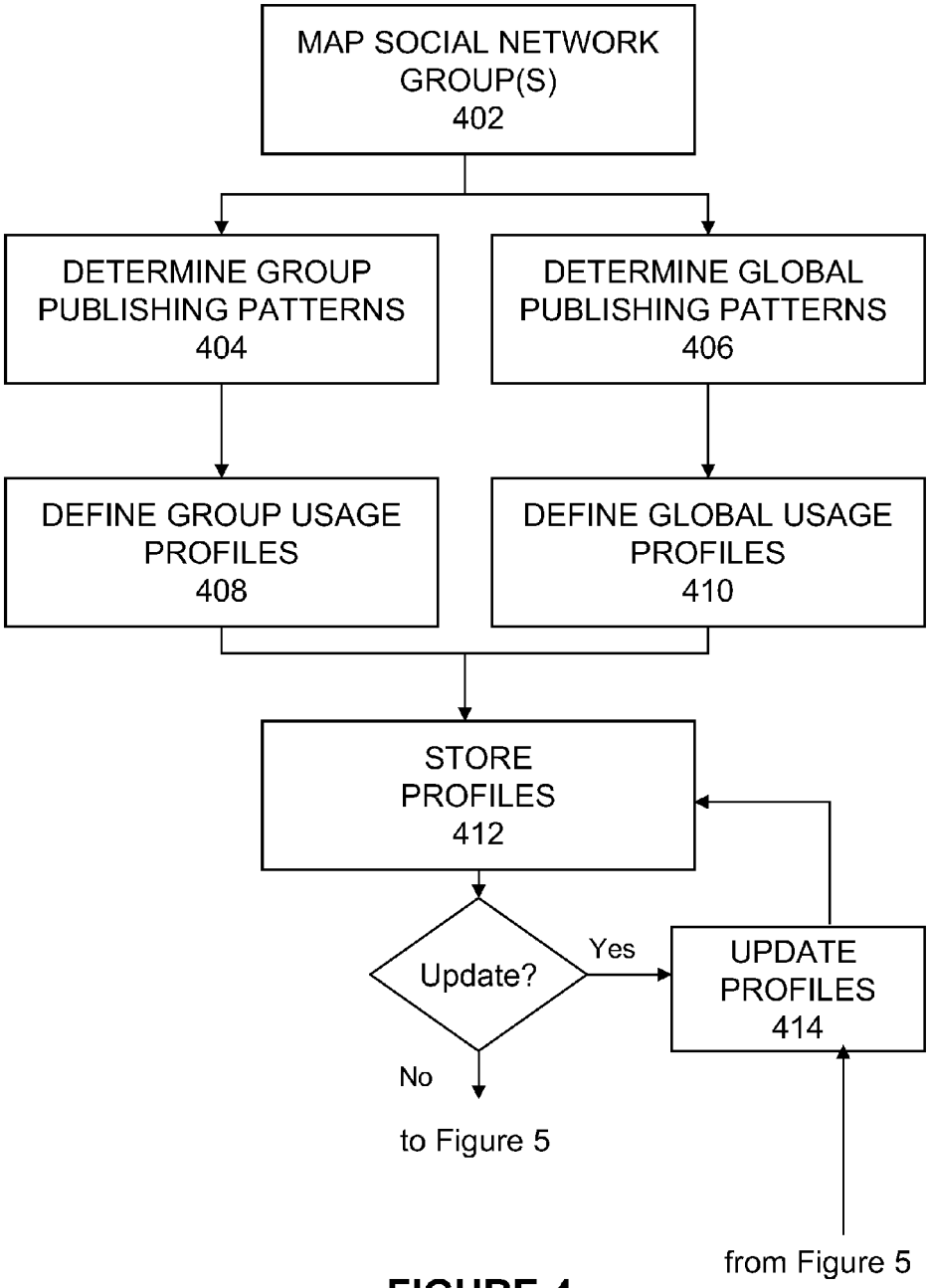
FIG. 4 is a flowchart illustrating steps of the profiling engine 120 performed to map the social network and create usage profiles, according to one embodiment of the present invention.

Referring now to FIG. 4, there is shown a flowchart illustrating the operation of the profiling engine 120 in mapping the social network and creating usage profiles, according to some embodiments of the present invention. It should be understood that these steps are illustrative only. Different embodiments of the profiling engine 120 may perform the illustrated steps in different orders, omit certain steps, and/or perform additional steps not shown in FIG. 4 (the same is true for the detection engine 121 method steps described in FIG. 5). In some embodiments, the functions of the engines 120, 121 are performed by a single engine or module.

As shown in FIG. 4, the profiling engine 120 maps 402 a social networking group 115 having various members. The social networking group 115 is a subset of users within a social networking environment. The mapping 402 was described in detail above. The engine 120 then determines 404 a pattern of publishing activity of the members in posting information on blogs of other members of the social networking group over a period of time. In some embodiments, the engine 120 determines 404 the pattern of the group by determining the pattern of publishing activity for each member of the group in posting information on blogs of other members. In some embodiments, the engine 120 further determines 406 a pattern of global publishing activity of users in posting information on blogs of other users in the social networking environment.

The engine 120 defines 408 one or more group usage profiles for the social networking group 115 based on the determination 404 of the pattern of publishing activity of the members. The group usage profile can include a catalog of signatures for normal usage patterns of the social networking group during different times of a day, different days of a week, different weeks of the month, and different months of a year. In some embodiments, the engine 120 first defines member usage profiles for each member of the social networking group 115 based on the pattern of publishing activity for that member in posting information on blogs of other members. The member usage profiles can be used to generate 408 the group usage profile for the social networking group.

In some embodiments the engine 120 further defines 410 one or more global usage profiles for the social networking environment based on the determination 406 of the pattern of global publishing activity of users in posting information on blogs of other users in the social networking environment. The global usage profile can include a spam usage profile including a plurality of known blog spam signatures. In some embodiments, the global usage profile also includes a holiday or other time-dependent usage profile defining typical usage patterns for the users of the social networking environment during holidays/specific times.

Once the profiles 408, 410 are defined, the engine 120 can store 412 the profiles in the profile database 105. The engine 120 can also determine whether or not the profiles need updating (and can regularly update them over time). If so, the engine 120 can update 414 the profiles over time to include new usage patterns. The profiles are then used by the detection engine 121 in detecting spam, as described in FIG. 5.

Figure 5:
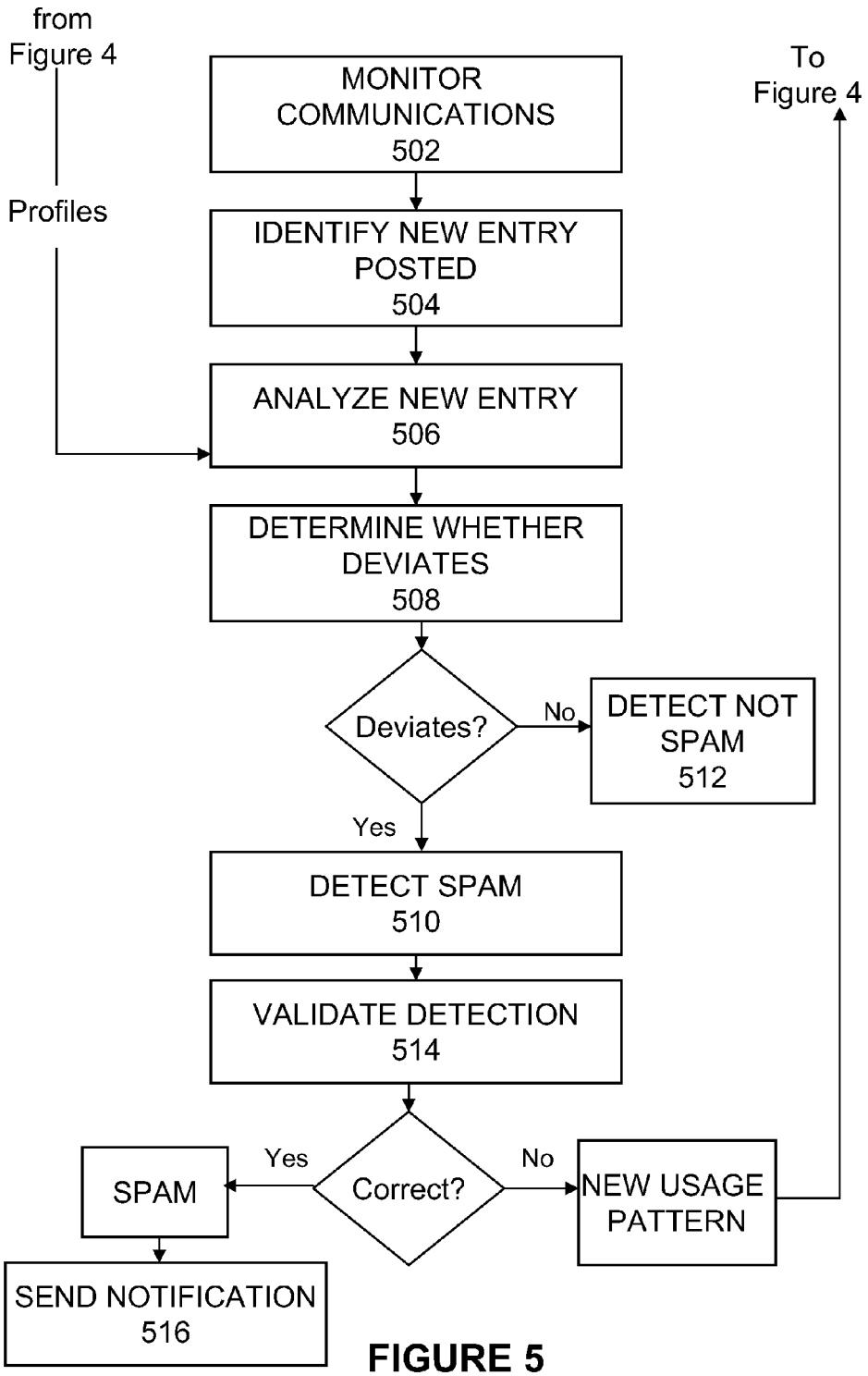
FIG. 5 is a flowchart illustrating steps of the detection engine 121 performed to detect spam using the usage profiles, according to one embodiment of the present invention.

Referring now to FIG. 5, there is shown a flowchart illustrating the operation of the detection engine 121 in detecting spam using the usage profiles, according to some embodiments of the present invention. The detection engine 121 monitors 502 communications of social networking groups 115, and identifies 504 when a new entry has been posted on a blog of one of the members of a social networking group. The engine 121 can determine who is the owner of the blog, and to which group he belongs. The engine 121 then analyzes 506 the new entry in comparison to the group usage profile(s) for the social networking group. In addition, the engine 121 can analyze 506 the entry in comparison to global usage profile(s) for the social networking environment (e.g., spam usage profile, holiday usage profile, etc.).

The engine 121 determines 508 whether the new entry deviates from the pattern of publishing activity of the members of the group. The engine 121 can also determine 508 whether the entry matches any spam profiles or whether the entry deviates from the global activity of other users. Responsive to a determination that the new entry deviates from the group usage pattern, the engine 121 detects 510 that the new entry is spam. If the determination is that the new entry does not deviate from the pattern, the engine 121 detects 512 that the entry is not spam.

In some embodiment, the engine 121 further performs a validation 514 of the spam detection. In this validation, the engine 121 can decide that the prior detection of spam was correct. The engine 121 can also decide that the detection was incorrect. In this case, the engine 121 can determine that the deviating new entry actually represents a new pattern of publishing activity. For example, if the deviating entry is found not to match any spam profiles, it might be a new usage pattern of legitimate users rather than a spammer. In response, the engine 121 can decide that the new entry is not spam and can store the new usage pattern in the relevant profile. In some embodiments, the engine 121 sends out a notification when spam has been detected. As explained above, the spam can be dealt with by condensing the spam entries, by deleting the spam, or by various known methods for spam management.

The above description is included to illustrate the operation of the embodiments and is not meant to limit the scope of the invention. The scope of the invention is to be limited only by the following claims. From the above discussion, many variations will be apparent to one skilled in the relevant art that would yet be encompassed by the spirit and scope of the invention. As used herein any reference to "one embodiment" or "an embodiment" means that a particular element, feature, structure, or characteristic described in connection with the embodiment is included in at least one embodiment. The appearances of the phrase "in one embodiment" in various places in the specification are not necessarily all referring to the same embodiment.

I claim:

1. A computer-implemented method for detecting social networking spam, the method comprising:

using a computer processor to execute method steps comprising:

selecting a central member who is a user of a social networking environment;

measuring degrees of association between the central member and other users of the social networking environment;

defining a social networking group containing the central member and other members, where the other members are a subset of the other users of the social networking environment selected responsive to the other users' degrees of association with the central member;

identifying that a new entry has been posted on a blog of the central member;

analyzing the new entry in comparison to a group usage profile for the social networking group, the group usage profile indicating a pattern of publishing activity of the members of the social networking group in posting information on blogs of other members of the social networking group over a period of time;

responsive to the analysis in comparison to the group usage profile indicating that the new entry deviates from the pattern of publishing activity, analyzing the new entry using a global usage profile comprising a spam usage profile to determine whether the new entry matches a spam signature representing known spam;

detecting that the new entry is spam responsive to analyzing the new entry using the global usage profile; and determining a pattern of global publishing activity of users in posting information on blogs of other users in the social networking environment;

wherein the global usage profile is based in part on the determined pattern of global publishing activity.

2. The method of claim 1, wherein the group usage profile comprises a catalog of signatures for normal usage patterns of the social networking group during different times of a day, different days of a week, and different months of a year.

3. The method of claim 1, further comprising:

validating that the new entry is spam responsive to determining that a user that posted the new entry was not logged in while posting the new entry.

4. The method of claim 1, wherein selecting the central member comprises:

randomly selecting a user of the social networking environment for whom the social networking group will be defined.

5. The method of claim 1, wherein measuring degrees of association comprises:

assigning a degree of association of a user of the social networking environment to the central member responsive to a frequency of correspondence between the user and the central member.

6. A non-transitory computer-readable storage medium storing executable computer program instructions for detecting social networking spam, the computer program instructions comprising instructions for performing steps comprising:

selecting a central member who is a user of a social networking environment;

measuring degrees of association between the central member and other users of the social networking environment;

defining a social networking group containing the central member and other members, where the other members are a subset of the other users of the social networking environment selected responsive to the other users' degrees of association with the central member;

identifying that a new entry has been posted on a blog of the central member;

analyzing the new entry in comparison to a group usage profile for the social networking group, the group usage profile indicating a pattern of publishing activity of the members of the social networking group in posting information on blogs of other members of the social networking group over a period of time;

responsive to the analysis in comparison to the group usage profile indicating that the new entry deviates from the pattern of publishing activity, analyzing the new entry using a global usage profile comprising a spam usage profile to determine whether the new entry matches a spam signature representing known spam;

detecting that the new entry is spam responsive to analyzing the new entry using the global usage profile; and determining a pattern of global publishing activity of users in posting information on blogs of other users in the social networking environment;

wherein the global usage profile is based in part on the determined pattern of global publishing activity.

7. The computer-readable storage medium of claim 6, wherein the global usage profile comprises a holiday usage profile, wherein the new entry deviating from the pattern of the holiday usage profile during a holiday season indicates that the new entry is spam.

8. The computer-readable storage medium of claim 6, wherein the group usage profile comprises a catalog of signatures for normal usage patterns of the social networking group during different times of a day, different days of a week, and different months of a year.

9. The computer-readable storage medium of claim 6, further comprising updating the group usage profile to include new usage patterns of the social networking group identified over time.

10. A computer system for detecting social networking spam, the system comprising:

a computer-readable storage medium storing executable software modules, comprising:

a selection module for:

selecting a central member who is a user of a social networking environment;

measuring degrees of association between the central member and other users of the social networking environment; and defining a social networking group containing the central member and other members, where the other members are a subset of the other users of the social networking environment selected responsive to the other users' degrees of association with the central member;

an identification module for identifying that a new entry has been posted on a blog of the central member;

an analysis module for:

analyzing the new entry in comparison to a group usage profile for the social networking group, the group usage profile indicating a pattern of publishing activity of the members of the social networking group in posting information on blogs of other members of the social networking group over a period of time;

responsive to the analysis in comparison to the group usage profile indicating that the new entry deviates from the pattern of publishing activity, analyzing the new entry using a global usage profile comprising a spam usage profile to determine whether the new entry matches a spam signature representing known spam; and a spam detection module for detecting that the new entry is spam, responsive to analyzing the new entry using the global usage profile; and a pattern module for determining a pattern of global publishing activity of users in posting information on blogs of other users in the social networking environment;

wherein the global usage profile is based on the determined pattern of global publishing activity; and a processor configured to execute the software modules stored by the computer readable storage medium.

11. The system of claim 10, further comprising a profiling module for defining a member usage profile for each member of the social networking group based on a pattern of publishing activity for that member in posting information on blogs of other members, the member usage profile for each member used to generate the group usage profile for the social networking group.

12. The system of claim 10, further comprising a rendering module for rendering on a client the blog without the new entry that was detected to be spam or with the new entry consolidated with other similar entries detected to be spam.

13. The system of claim 10, further comprising:

a validation module for validating that the new entry is spam responsive to determining that a user that posted the new entry was not logged in while posting the new entry.

* * * * *